US009343076B2

(12) United States Patent
Davis

(10) Patent No.: US 9,343,076 B2
(45) Date of Patent: May 17, 2016

(54) METHODS AND SYSTEMS FOR GENERATING FILTER COEFFICIENTS AND CONFIGURING FILTERS

(75) Inventor: Mark F. Davis, Pacifica, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 238 days.

(21) Appl. No.: 13/983,892

(22) PCT Filed: Feb. 8, 2012

(86) PCT No.: PCT/US2012/024270

§ 371 (c)(1),
(2), (4) Date: Aug. 6, 2013

(87) PCT Pub. No.: WO2012/112357

PCT Pub. Date: Aug. 23, 2012

(65) Prior Publication Data

US 2013/0317833 A1 Nov. 28, 2013

Related U.S. Application Data

(60) Provisional application No. 61/443,360, filed on Feb. 16, 2011.

(51) Int. Cl.
*G10L 19/00* (2013.01)
*G10L 19/04* (2013.01)

(52) U.S. Cl.
CPC ..... *G10L 19/04* (2013.01); *G10L 19/0017* (2013.01)

(58) Field of Classification Search
USPC ..... 704/500–504
See application file for complete search history.

(56) References Cited

U.S. PATENT DOCUMENTS 6,664,913 B1 12/2003 Craven
7,155,177 B2 * 12/2006 Jootar et al. ..... 455/101

(Continued)

FOREIGN PATENT DOCUMENTS

EP 1275200 1/2003
EP 2237573 10/2010

(Continued)

OTHER PUBLICATIONS

Chen, S. et al. "Digital IIR Filter Design Using Particle Swarm Optimisation" International Journal of Modelling, Identification and Control, vol. 9, No. 4, 2010, pp. 327-335.

(Continued)

*Primary Examiner* — Leonard Saint Cyr

(57) ABSTRACT

Methods for generating a palette of feedback (IIR) filter coefficient sets and using the palette to configure (e.g., adaptively update) a prediction filter which includes a feedback filter, and a system for performing any of the methods. Examples of the system include an encoder, including a prediction filter and configured to encode data indicative of a waveform signal (e.g., samples of an audio signal), and a decoder. In some embodiments, the prediction filter is included in an encoder operable to generate (and assert to a decoder) encoded data including filter coefficient data indicative of the selected IIR coefficient set with which the prediction filter was configured during generation of the encoded data. In some embodiments, the timing with which adaptive updating of prediction filter configuration occurs or is allowed to occur is constrained (e.g., to optimize efficiency of prediction encoding).

18 Claims, 2 Drawing Sheets

(56) References Cited

U.S. PATENT DOCUMENTS

| | | | | |
|---|---|---|---|---|
| 7,224,747 | B2 * | 5/2007 | Rijnberg et al. | 375/296 |
| 7,373,367 | B2 | 5/2008 | Lee | |
| 7,508,870 | B2 | 3/2009 | Denk | |
| 7,596,220 | B2 | 9/2009 | Yeh | |
| 7,742,912 | B2 | 6/2010 | Den Brinker | |
| 7,756,498 | B2 | 7/2010 | Park | |
| 8,135,047 | B2 * | 3/2012 | Rajendran et al. | 370/536 |
| 2001/0033616 | A1 * | 10/2001 | Rijnberg et al. | 375/232 |
| 2004/0157567 | A1 * | 8/2004 | Jootar et al. | 455/101 |
| 2006/0147031 | A1 * | 7/2006 | Yeh et al. | 379/406.08 |
| 2007/0118367 | A1 | 5/2007 | Dickson | |
| 2008/0027718 | A1 * | 1/2008 | Krishnan et al. | 704/211 |
| 2008/0075215 | A1 | 3/2008 | Dong | |
| 2008/0112569 | A1 | 5/2008 | Asada | |
| 2008/0250090 | A1 | 10/2008 | Eitel | |
| 2009/0034747 | A1 | 2/2009 | Christoph | |
| 2009/0076830 | A1 | 3/2009 | Taleb | |
| 2010/0027625 | A1 | 2/2010 | Wik | |
| 2010/0034398 | A1 | 2/2010 | Odent et al. | |
| 2010/0135172 | A1 | 6/2010 | Cui | |
| 2010/0174541 | A1 | 7/2010 | Vos | |
| 2010/0189169 | A1 | 7/2010 | Eleftherious | |
| 2010/0217790 | A1 | 8/2010 | Yang | |

FOREIGN PATENT DOCUMENTS

| | | |
|---|---|---|
| JP | H05-257497 | 10/1993 |
| JP | 2000-242299 | 9/2000 |
| JP | 2010-141780 | 6/2010 |
| RU | 2390856 | 5/2010 |
| RU | 2402826 | 10/2010 |
| WO | 2008/122930 | 10/2008 |
| WO | 2010/027722 | 3/2010 |
| WO | 2010/041381 | 4/2010 |

OTHER PUBLICATIONS

Muuma, A. et al. "Adaptive IIR Notch Filter with Controlled Bandwidth for Narrow-Band Interference Suppression in DS CDMA System" Proc. of the 2003 IEEE International Symposium on Circuits and Systems, vol. 4, 2003.

Hans, M. et al. "Lossless Compression of Digital Audio" IEEE Signal Processing Magazine, IEEE Service Center, Piscataway, NJ, US, vol. 18, No. 4, Jul. 1, 2001, pp. 21-32.

* cited by examiner

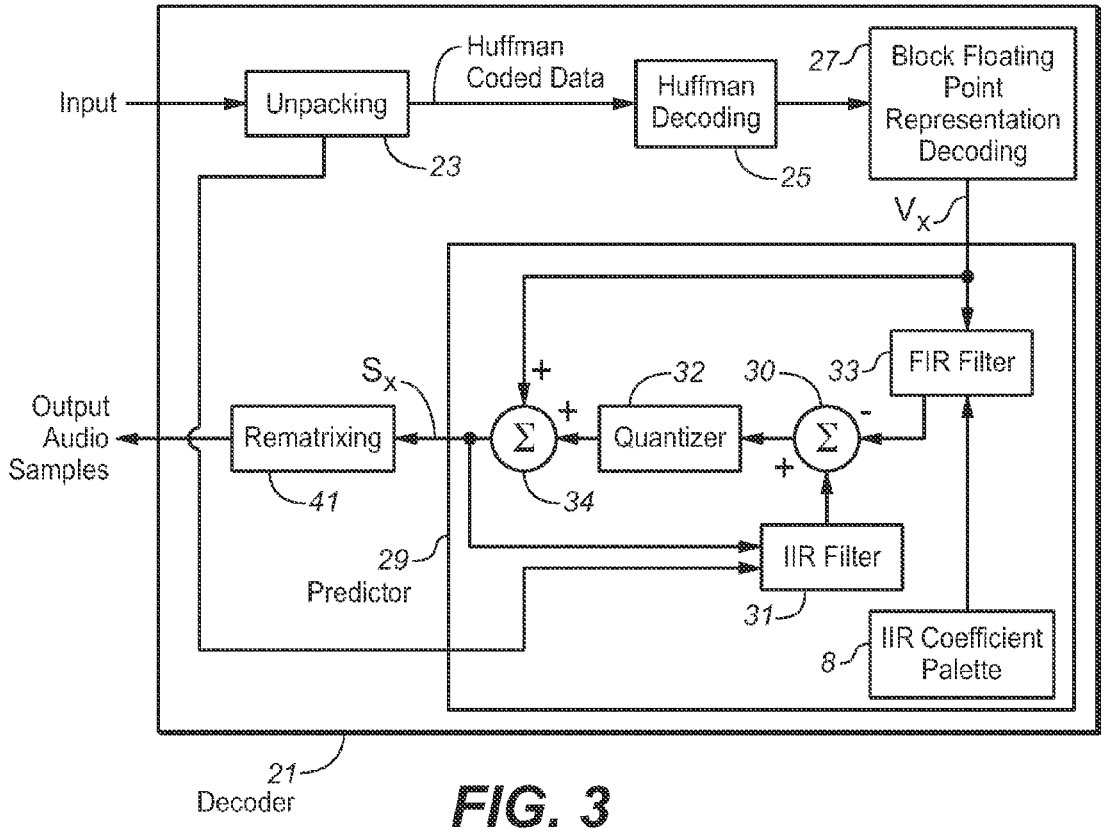
FIG. 3
FIG. 4
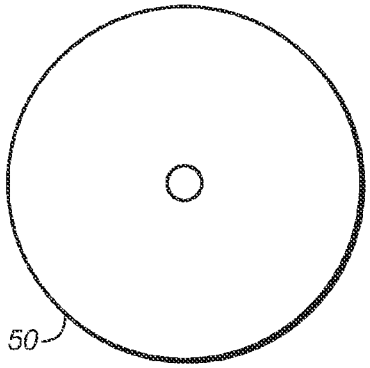

METHODS AND SYSTEMS FOR GENERATING FILTER COEFFICIENTS AND CONFIGURING FILTERS

CROSS-REFERENCE TO RELATED APPLICATIONS

This application claims priority to U.S. Provisional Patent Application No. 61/443,360 filed 16 Feb. 2011, which is hereby incorporated by reference in its entirety.

TECHNICAL FIELD

The invention relates to methods and systems for configuring (including by adaptively updating) a prediction filter (e.g., a prediction filter in an audio data encoder or decoder). Typical embodiments of the invention are methods and systems for generating a palette of feedback filter coefficients, and using the palette to configure (e.g., adaptively update) a feedback filter which is (or is an element of) a prediction filter (e.g., a prediction filter in an audio data encoder or decoder).

BACKGROUND

Throughout this disclosure including in the claims, the expression performing an operation (e.g., filtering or transforming) "on" signals or data is used in a broad sense to denote performing the operation directly on the signals or data, or on processed versions of the signals or data (e.g., on versions of the signals that have undergone preliminary filtering prior to performance of the operation thereon).

Throughout this disclosure including in the claims, the expression "system" is used in a broad sense to denote a device, system, or subsystem. For example, a subsystem that predicts a next sample in a sample sequence may be referred to as a prediction system (or predictor), and a system including such a subsystem (e.g., a processor including a predictor that predicts a next sample in a sample sequence, and means for using the predicted samples to perform encoding or other filtering) may also be referred to as a prediction system or predictor.

Throughout this disclosure including in the claims, the verb "includes" is used in a broad sense to denote "is or includes," and other forms of the verb "include" are used in the same broad sense. For example, the expression "a prediction filter which includes a feedback filter" (or the expression "a prediction filter including a feedback filter") herein denotes either a prediction filter which is a feedback filter (i.e., does not include a feedforward filter), or prediction filter which includes a feedback filter (and at least one other filter, e.g., a feedforward filter).

A predictor is a signal processing element (e.g., a stage) used to derive an estimate of an input signal (e.g., a current sample of a stream of input samples) from some other signal (e.g., samples in the stream of input samples other than the current sample) and optionally also to filter the input signal using the estimate. Predictors are often implemented as filters, generally with time varying coefficients responsive to variations in signal statistics. Typically, the output of a predictor is indicative of some measure of the difference between the estimated and original signals.

A common predictor configuration found in digital signal processing (DSP) systems uses a sequence of samples of a target signal (a signal that is input to the predictor) to estimate or predict a next sample in sequence. The intent is usually to reduce the amplitude of the target signal by subtracting each predicted component from the corresponding sample of the target signal (thereby generating a sequence of residuals), and typically also to encode the resulting sequence of residuals. This is desirable in data rate compression codec systems, since required data rate usually decreases with diminishing signal level. The decoder recovers the original signal from the transmitted residuals (which may be encoded residuals) by performing any necessary preliminary decoding on the residuals, and then replicating the predictive filtering used by the encoder, and adding each predicted/estimated value to the corresponding one of the residuals.

Throughout this disclosure including in the claims, the expression "prediction filter" denotes either a filter in a predictor or a predictor implemented as a filter.

Any DSP filter, including those used in predictors, can at least mathematically be classified as a feedforward filter (also known as a finite impulse response or "FIR" filter) or a feedback filter (also known as an infinite impulse response or "IIR" filter), or a combination of IIR and FIR filters. Each type of filter (IIR and FIR) has characteristics that may make it more amenable to one or another application or signal condition.

The coefficients of a prediction filter must be updated as necessary in response to signal dynamics in order to provide accurate estimates. In practice, this imposes the need to be able to rapidly and simply calculate acceptable (or optimal) filter coefficients from the input signal. Appropriate algorithms exist for feedforward prediction filters, such as the Levinson-Durbin recursion method, but equivalent algorithms for feedback predictors do not exist. For this reason, most practical predictor embodiments employ just the feedforward architecture, even when signal conditions might favor the use of a feedback arrangement.

U.S. Pat. No. 6,664,913, issued Dec. 16, 2003 and assigned to the assignee of the present invention, describes an encoder and a decoder for decoding the encoder's output. Each of the encoder and the decoder includes a prediction filter. In a class of embodiments (e.g., the embodiment shown in FIG. 2 of the present disclosure), the prediction filter includes both an IIR filter and an FIR filter and is designed for use in encoding of data indicative of a waveform signal (e.g., an audio or video signal). In the embodiment shown in FIG. 2, the prediction filter includes FIR filter 57 (connected in the feedback configuration shown in FIG. 2) and FIR filter 59, whose outputs are combined by subtraction stage 56. The difference values output from stage 56 are quantized in quantization stage 60. The output of stage 60 is summed with the input samples ("S") in summing stage 61. In operation, the predictor of FIG. 2 can assert (as the output of stage 61) residual values (identified in FIG. 2 as residuals "R"), each indicative of a sum of an input sample ("S") and a quantized, predicted version of such sample (where such predicted version of the sample is determined by the difference between the outputs of filters 57 and 59).

Commercially available encoders and decoders that embody the "Dolby TrueHD" technology, developed by Dolby Laboratories Licensing Corporation, employ encoding and decoding methods of the type described in U.S. Pat. No. 6,664,913. An encoder that embodies the Dolby TrueHD technology is a lossless digital audio coder, meaning that the decoded output (produced at the output of a compatible decoder) must match the input to the encoder exactly, bit-for-bit. Essentially, the encoder and decoder share a common protocol for expressing certain classes of signals in a more compact form, such that the transmitted data rate is reduced but the decoder can recover the original signal.

U.S. Pat. No. 6,664,913 suggests that filters 57 and 59 (and similar prediction filters) can be configured to minimize the encoded data rate (the data rate of the output "R") by trying each of a small set of possible filter coefficient choices (using each trial set to encode the input waveform), selecting the set that gives the smallest average output signal level or the smallest peak level in a block of output data (generated in response to a block of input data), and configuring the filters with the selected set of coefficients. The patent further suggests that the selected set of coefficients can be transmitted to the decoder, and loaded into a prediction filter in the decoder to configure the prediction filter.

U.S. Pat. No. 7,756,498, issued Jul. 13, 2010, discloses a mobile communication terminal which moves at variable speed while receiving a signal. The terminal includes a predictor that includes a first-order IIR filter, and a list of predetermined pairs of IIR filter coefficients is provided to the predictor. During operation of the terminal (while it moves at a specific speed), a pair of predetermined IIR filter coefficients is selected from the candidate filter list for configuring the filter (the selection is based on comparison of prediction results to results in which noise does not occur). The selection can be updated as the terminal's speed varies, but there is no suggestion to address the issue of signal continuity in the face of changing filter coefficients. The reference does not teach how the candidate filter list is generated, except to state that each pair in the list is determined as a result of experimentation (not described) to be suitable for configuring the filter when the terminal is moving at a different speed.

Although it has been proposed to adaptively update an IIR filter (e.g., filter 57 in the FIG. 2 system) of a prediction filter (e.g., to minimize the output signal energy from moment to moment), until the present invention it had not been known how to do so effectively, rapidly, and efficiently (e.g. to optimize the IIR filter, and/or a prediction filter including the IIR filter, rapidly and effectively for use under the relevant signal conditions, which may change over time). Nor had it been known how to do so in a manner addressing the issue of signal continuity under the condition of changing filter coefficients.

U.S. Pat. No. 6,664,913 also suggests determining a first group of possible prediction filter coefficient sets (a small number of sets from which a desired set can be selected) to include sets that determine widely differing filters matched to typically expected waveform spectra. Then a second coefficient selection step can be performed (after a best one of the sets in the first group is selected) to make a refined selection of a best filter coefficient set from a small second group of possible prediction filter coefficient sets, where all the sets in the second group determine filters similar to the filter selected during the first step. This process can be iterated, each time using a more similar group of possible prediction filters than was used in the previous iteration.

Although it has been proposed to generate one or more small groups of possible prediction filter coefficient sets (from which a desired coefficient set can be selected to configure a prediction filter), until the present invention it had not been known how to determine such a small group effectively and efficiently, so that each set in the group is useful to optimize (or adaptively update) an IIR filter (or a prediction filter including an IIR filter) for use under relevant signal conditions.

BRIEF DESCRIPTION OF THE INVENTION

In a class of embodiments, the invention is a method for using a predetermined palette of IIR (feedback) filter coefficient sets to configure (e.g., adaptively update) an IIR filter which is (or is an element of) a prediction filter. Typically, the prediction filter is included in an audio data encoding system (encoder) or an audio data decoding system (decoder). In typical embodiments, the method uses a predetermined palette of sets of IIR filter coefficients ("IIR coefficient sets") to configure a prediction filter that includes both an IIR filter and an FIR (feedforward) filter, and the method includes steps of: for each of the IIR coefficient sets in the palette, generating configuration data indicative of output generated by applying the IIR filter configured with said each of the IIR coefficient sets to input data, and identifying (as a selected IIR coefficient set) one of the IIR coefficient sets which configures the IIR filter to generate configuration data having a lowest level (e.g., lowest RMS level) or which configures the IIR filter to meet an optimal combination of criteria (including the criterion of that the configuration data have a lowest level); then determining an optimal FIR filter coefficient set by performing a recursion operation (e.g., Levinson-Durbin recursion) on test data indicative of output generated by applying the prediction filter to input data with the IIR filter configured with the selected IIR coefficient set (typically, a predetermined FIR filter coefficient set is employed as an initial candidate FIR coefficient set for the recursion, and other candidate sets of FIR filter coefficients are employed in successive iterations of the recursion operation until the recursion converges to determine the optimal FIR filter coefficient set), and configuring the FIR filter with the optimal FIR coefficient set and configuring the IIR filter with the selected IIR coefficient set, thereby configuring the prediction filter.

When the prediction filter is included in an encoder and has been configured, the encoder can be operated to generate encoded output data by encoding input data (with the prediction filter typically generating residual values which are employed to generate the encoded output data), and the encoded output data can be asserted (e.g., to a decoder or to a storage medium for subsequent provision to a decoder) with filter coefficient data indicative of the selected IIR coefficient set (with which the IIR filter was configured during generation of the encoded output data). The filter coefficient data are typically the selected IIR coefficient set itself, but alternatively could be data (e.g., an index to a palette or look-up table) indicative of the selected IIR coefficient set.

In some embodiments, the selected IIR coefficient set (the coefficient set in the palette which is selected to configure the IIR filter) is identified as the IIR coefficient set in the palette which configures the IIR filter to generate output data (in response to input data) having a lowest value of A+B, where "A" is the level (e.g., RMS level) of the output data and "B" is the amount of side chain data needed to identify the IIR coefficient set (e.g., the amount of side chain data that must be transmitted to a decoder to enable the decoder to identify the IIR coefficient set) and optionally also any other side chain data required for decoding data that have been encoded using the prediction filter configured with the IIR coefficient set. This criterion is appropriate in some embodiments since some of the IIR coefficient sets in the palette may comprise longer (more precise) coefficients than others, so that a less-effective IIR filter (considering just RMS of output data) determined by short coefficients may be chosen over a slightly more effective IIR filter determined by longer coefficients.

In some embodiments, the timing (e.g., frequency) with which adaptive updating of configuration of a prediction filter (which includes an IIR filter, or an IIR filter and an FIR filter) occurs or is allowed to occur is constrained (e.g., to optimize efficiency of prediction encoding). For example, each time a prediction filter of a typical lossless encoder is reconfigured (in accordance with an embodiment of the invention), there is a state change in the encoder that may require that overhead data (side chain data) indicative of the new state be transmitted to allow a decoder to account for each state change during decoding. However, if the encoder state change occurs for some reason that is not a prediction filter reconfiguration (e.g., a state change occurring upon commencement of processing of a new block, e.g., macroblock, of samples), overhead data indicative of the new state must also be transmitted to the decoder so that a prediction filter reconfiguration might be performed at this time without adding (or without adding significantly or intolerably) to the amount of overhead that must be transmitted. In some embodiments of the inventive encoding method and system, a continuity determination operation is performed to determine when there is an encoder state change, and timing of prediction filter reconfiguration operations is controlled accordingly (e.g., prediction filter reconfiguration is deferred until occurrence of a state change event).

In another class of embodiments, the invention is a method for generating a predetermined palette of IIR filter coefficients that can be used to configure (e.g., adaptively update) an IIR ("feedback") prediction filter (i.e., an IIR filter which is or is an element of a prediction filter). The palette comprises at least two sets (typically a small number of sets) of IIR filter coefficients, each of the sets consisting coefficients sufficient to configure the IIR filter. In a class of embodiments, each set of coefficients in the palette is generated by performing nonlinear optimization over a set (a "training set") of input signals, subject to at least one constraint. Typically, the optimization is performed subject to multiple constraints, including at least two of best prediction, maximum filter Q, ringing, allowed or required numerical precision of the filter coefficients (e.g., the requirement that each coefficient in a set must consist of not more than X bits, where X may be equal to 14 bits for example), transmission overhead, and filter stability constraints. At least one nonlinear optimization algorithm (e.g., Newtonian optimization and/or Simplex optimization) is applied for each block of each signal in the training set, to arrive at a candidate optimal set of filter coefficients for the signal. The candidate optimal set is added to the palette if the IIR filter determined thereby satisfies each constraint, but is rejected (and not added to the palette) if the IIR filter violates at least one constraint (e.g., if the IIR filter is unstable). If a candidate optimal set is rejected, an equally good (or next best) candidate set (determined by the same optimization on the same signal) may be added to the palette if the equally good (or next best) candidate set satisfies each constraint, and the process iterates until a coefficient set (determined from the signal) has been added to the palette. The palette may include filter coefficients sets determined using different constrained optimization algorithms (e.g., constrained Newtonian optimization and constrained Simplex optimization may be performed separately, and the best solutions from each culled for inclusion in the palette). If the constrained optimization yields an unacceptably large initial palette, a pruning process is employed to reduce the size of the palette (by deleting at least one set from the initial palette), based on a combination of histogram accumulation and net improvement provided by each coefficient set in the initial palette over the signals in the training set.

Preferably, the palette of IIR filter coefficient sets is determined so that it includes coefficient sets that will optimally configure an IIR prediction filter for use with any input signal having characteristics in an expected range.

Aspects of the invention include a system (e.g., an encoder, a decoder, or a system including both an encoder and a decoder) configured (e.g., programmed) to perform any embodiment of the inventive method, and a computer readable medium (e.g., a disc) which stores code for programming a processor or other system to perform any embodiment of the inventive method.

BRIEF DESCRIPTION OF THE DRAWINGS

FIG. 3 is a block diagram of a decoder configured to decode data that have been encoded by the FIG. 1 encoder. The decoder of FIG. 3 includes an IIR filter which is configured (and adaptively updated) in accordance with an embodiment of the invention.

FIG. 4 is an elevational view of a computer readable optical disk on which is stored code for implementing an embodiment of the inventive method.

DETAILED DESCRIPTION OF THE PREFERRED EMBODIMENTS

Many embodiments of the present invention are technologically possible. It will be apparent to those of ordinary skill in the art from the present disclosure how to implement them. Embodiments of the inventive system, method, and medium will be described with reference to FIGS. 1, 3, and 4.

Figure 1:
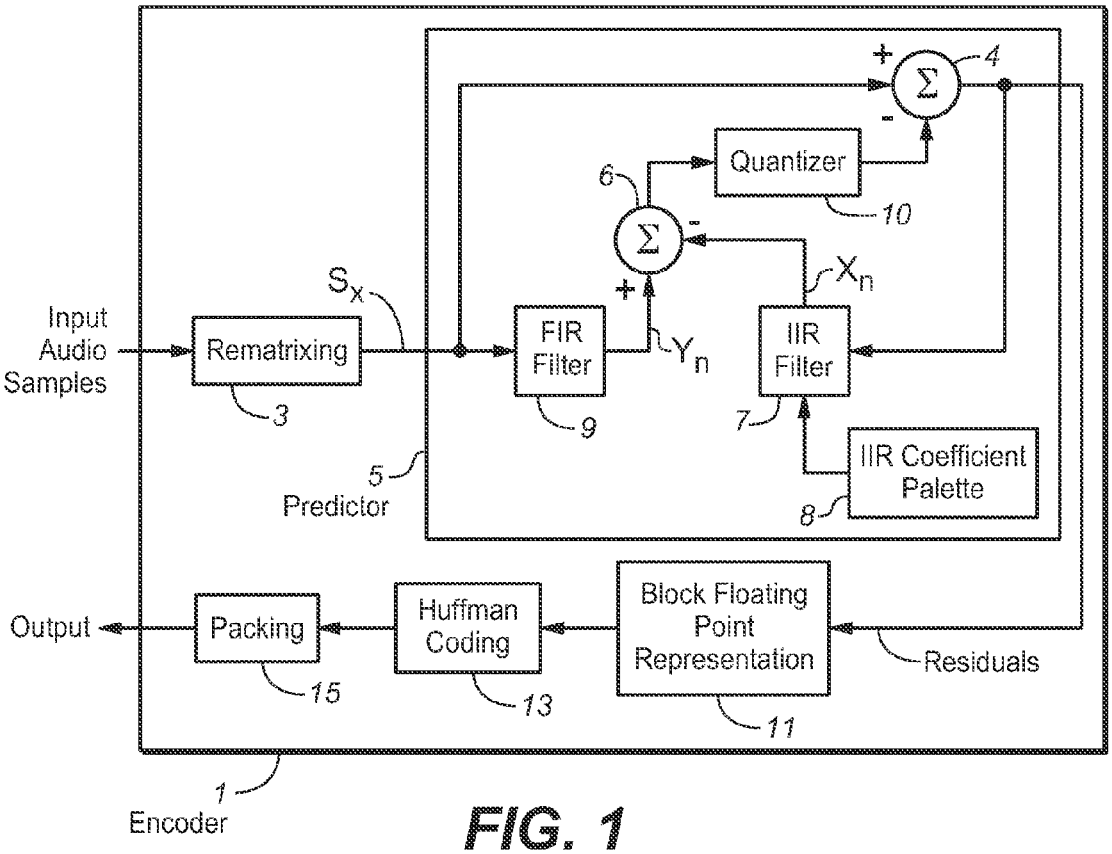
FIG. 1 is a block diagram of an encoder including prediction filter including an IIR filter (7) and an FIR filter (9). The prediction filter is configured (and adaptively updated) using a predetermined palette (8) of IIR coefficient sets in accordance with an embodiment of the invention.

In a typical embodiment, each of the FIG. 1 system and the system of FIG. 3 is implemented as a digital signal processor (DSP) whose architecture is suitable for processing the expected input data (e.g., audio samples) and which is configured (e.g., programmed) with appropriate firmware and/or software to implement an embodiment of the inventive method. The DSP could be implemented as an integrated circuit (or chip set) and would include program and data memory accessible by its processor(s). The memory would include non-volatile memory adequate to store the filter coefficient palette, program data, and other data required to implement each embodiment of the inventive method to be performed. Alternatively, one or both of the FIG. 1 and FIG. 3 systems (or another embodiment of the invention) is implemented as a general purpose processor programmed with appropriate software to implement an embodiment of the inventive method, or is implemented in appropriately configured hardware.

Typically, multiple channels of input data samples are asserted to the inputs of encoder 1 (of FIG. 1). Each channel typically includes a stream of input audio samples and can correspond to a different channel of a multi-channel audio program. In each channel, encoder 1 typically receives relatively small blocks ("microblocks") of input audio samples. Each microblock may consist of 48 samples.

Encoder 1 is configured to perform the following functions: a rematrixing operation (represented by rematrixing stage 3 of FIG. 1), a prediction operation (including generation of predicted samples and generating residuals therefrom) represented by predictor 5, a block floating point representation encoding operation (represented by stage 11), a Huffman encoding operation (represented by Huffman coding stage 13), and a packing operation (represented by packing stage 15). In some implementations, encoder 1 is a digital signal processor (DSP) programmed and otherwise configured to perform these functions (and optionally additional functions) in software.

Rematrixing stage 3 encodes the input audio samples (to reduce their size/level in a reversible manner), thereby generating coded samples. In typical implementations in which multiple channels of input samples are input to the rematrixing stage 3 (e.g., each corresponding to a channel of a multichannel audio program), stage 3 determines whether to generate a sum or a difference of samples of each of at least one pair of the input channels, and outputs either the sum and difference values (e.g., a weighted version of each such sum or difference) or the input samples themselves, with side chain data indicating whether the sum and difference values or the input samples themselves are being output. Typically, the sum and difference values output from stage 3 are weighted sums and differences of samples, and the side chain data include sum/difference coefficients. The rematrixing process performed in stage 3 forms sums and differences of input channel signals to cancel duplicate signal components. For example, two identical 16 bit channels could be coded (in stage 3) as a sum signal of 17 bits and a difference signal of silence, to achieve a potential savings of 15 bits per sample, less any side chain information needed to reverse the rematrixing in the decoder.

For convenience, the following description of the subsequent operations performed in encoder 1 refers to samples (and the encoding thereof) in a single one of the channels represented by the output of stage 3. It will be understood that the described coding is performed on the samples (identified in FIG. 1 as samples "$S_x$") in all the channels.

Predictor 5 performs the following operations: subtracting (represented by subtraction stage 4 and subtraction stage 6), IIR filtering (represented by IIR filter 7), FIR filtering (represented by FIR filter 9), quantization (represented by quantizing stage 10), configuration of IIR filter 7 (to implement sets of IIR coefficients selected from IIR coefficient palette 8), configuration of FIR filter 9, and adaptive updating of the configurations of filters 7 and 9. In response to the sequence of coded (rematrixed) samples generated in stage 3, predictor 5 predicts each "next" coded sample in the sequence. Filters 7 and 9 are implemented so that their combined outputs (in response to the sequence of coded samples from stage 3) are indicative of a predicted next coded sample in the sequence. The predicted next coded samples (generated in stage 6 by subtracting the output of filter 7 from the output of filter 9) are quantized in stage 10. Specifically, in quantizing stage 10, a rounding operation (e.g., to the nearest integer) is performed on each predicted next coded sample generated in stage 6.

In stage 4, predictor 5 subtracts each current value of the quantized, combined output, $P_n$, of filters 7 and 9 from each current value of the coded sample sequence from stage 3 to generate a sequence of residual values (residuals). The residual values are indicative of the difference between each coded sample from stage 3 and a predicted version of such coded sample. The residual values generated in stage 4 are asserted to block floating point representation stage 11.

More specifically, in stage 4 the quantized, combined output, $P_n$, of filters 7 and 9 (in response to prior samples, including the "(n−1)"th coded sample, of the sequence of coded samples from stage 3 and the sequence of residual values from stage 4) is subtracted from the "(n)"th coded sample of the sequence to generate the "(n)"th residual, where $P_n$ is a quantized version of the difference $Y_n-X_n$, where $X_n$ is the current value asserted at the output of filter 7 in response to the prior residual values, $Y_n$ is the current value asserted at the output of filter 9 in response to the prior coded samples in the sequence, and $Y_n-X_n$ is the predicted "(n)"th coded sample in the sequence.

Prior to operation of IIR filter 7 and FIR filter 9 to filter coded samples generated in stage 3, predictor 5 performs an IIR coefficient selection operation (to be described below) in accordance with an embodiment of the present invention to select a set of IIR filter coefficients (from those predetermined sets prestored in IIR coefficient palette 8, and configures the IIR filter 7 to implement the selected set of IIR coefficients therein. Predictor 5 also determines FIR filter coefficients for configuring FIR filter 9 for operation with the so-configured IIR filter 7. The configuration of filters 7 and 9 is adaptively updated in a manner to be described. Predictor 5 also asserts to packing stage 15 "filter coefficient" data indicative of the currently selected set of IIR filter coefficients (from palette 8), and optionally also the current set of FIR filter coefficients. In some implementations, the "filter coefficient" data are the currently selected set of IIR filter coefficients (and optionally also the corresponding current set of FIR filter coefficients). Alternatively, the filter coefficient data are indicative of the currently selected set of IIR (or FIR and IIR) coefficients. Palette 8 may be implemented as a memory of encoder 1, or as storage locations in a memory of encoder 1, into which a number of different predetermined sets of IIR filter coefficients have been preloaded (so as to be accessible by predictor 5 to configure filter 7 and to update filter 7's configuration).

In connection with the adaptive updating of the configurations of filters 7 and 9, predictor 5 is preferably operable to determine how many microblocks of the coded samples (generated in stage 3) to further encode using each determined configuration of filters 7 and 9. In effect, predictor 5 determines the size of a "macroblock" of the coded samples that will be encoded using each determined configuration of filters 7 and 9 (before the configuration is updated). For example, a preferred embodiment of predictor 5 may determine a number N (where N is in the range $1 \le N \le 128$) of the microblocks to encode using each determined configuration of filters 7 and 9. The configuration (and adaptive updating) of filters 7 and 9 will be described in greater detail below.

Block floating point representation stage 11 operates on the quantized residuals generated in prediction stage 5 and on side chain words ("MSB data") also generated in prediction stage 5. The MSB data are indicative of the most significant bits (MSBs) of the coded samples corresponding to the quantized residuals determined in prediction stage 5. Each of the quantized residuals is itself indicative of only least significant bits of a different one of the coded samples. The MSB data may be indicative of the most significant bits (MSBs) of the coded sample corresponding to the first quantized residual in each macroblock determined in prediction stage 5.

In block floating point representation stage 11, blocks of the quantized residuals and MSB data generated in predictor 5 are further encoded. Specifically, stage 11 generates data indicative of a master exponent for each block, and individual mantissas for the individual quantized residuals in each block.

Four key coding processes are used in encoder 1 of FIG. 1: rematrixing, prediction, Huffman coding, and block floating point representation. The block floating point representation process (implemented by stage 11) is preferably implemented to exploit the fact that quiet signals can be conveyed more compactly than loud signals. A block indicative of a full level 16-bit signal, for example, that is input to stage 11 may require all 16 bits of each sample to be conveyed (i.e., output from stage 11). However, a block of values indicative of a signal 48 dB lower in level (that is asserted to the input of stage 11) will only require that 8 bits per sample be output from stage 11, along with a side-chain word indicating that the upper 8 bits of each sample is unexercised and suppressed (and needs to be restored by the decoder).

In the FIG. 1 system, the goal of the rematrixing (in stage 3) and prediction encoding (in predictor 5) is to reduce the signal level as much as possible, in a reversible manner, to gain the maximum benefit from the block floating point coding in stage 11.

The coded values generated during stage 11 undergo Huffman coding in Huffman coder stage 13 to further reduce their size/level in a reversible manner. The resulting Huffman coded values are packed (with side chain data) in packing stage 15 for output from encoder 1. Huffman coder stage 13 preferably reduces the level of individual commonly-occurring samples by substituting for each a shorter code word from a lookup table (whose inverse is implemented in Huffman decoder 25 of the FIG. 3 system), allowing restoration of the original sample by inverse table lookup in the FIG. 3 decoder.

In packing stage 15, an output data stream is generated by packing together the Huffman coded values (from coder 13), side chain words (received from each stage of encoder 1 in which they are generated), and the filter coefficient data (from predictor 5) which determine the current configuration of IIR filter 7 (and typically also the current configuration of FIR filter 9). The output data stream is encoded data (indicative of the input audio samples) that is compressed data (since the encoding performed in encoder 1 is lossless compression). In a decoder (e.g., decoder 21 of FIG. 3), the output data stream can be decoded to recover the original input audio samples in lossless fashion.

Figure 2:
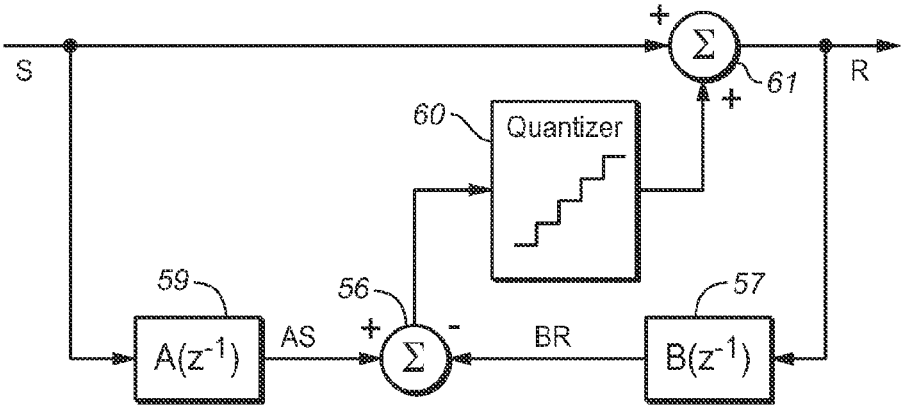
FIG. 2 (PRIOR ART)
FIG. 2 is a block diagram of a prediction filter, of a type employed in a conventional encoder, including an IIR filter and an FIR filter.

In alternative embodiments, the prediction filter of predictor stage 5 is implemented to have structure other than as shown in FIG. 1 (e.g., the structure of any of the embodiments described in above-cited U.S. Pat. No. 6,664,913), but is configurable (e.g., adaptively updatable) using a predetermined IIR coefficient palette in accordance with the present invention. The prediction filter of predictor stage 5 can be implemented (with the structure shown in FIG. 1) in a conventional manner (e.g., as described in above-cited U.S. Pat. No. 6,664,913), except that the conventional implementation is modified in accordance with an embodiment of the present invention so that the prediction filter is configurable (and adaptively updatable) using a predetermined IIR coefficient palette (palette 8) in accordance with the present invention. During such updating, a set of IIR filter coefficients (from those included in palette 8) is selected and employed to configure IIR filter 7, and FIR filter 9 is configured to operate acceptably (or optimally) with the so-configured filter 7. FIR filter 9 can be identical to FIR filter 59 of FIG. 2, except in that each value output from such implementation of filter 9 is the additive inverse of the value that would be output from filter 59 in response to the same input, subtraction stage 6 (of predictor 5 of FIG. 1) can replace subtraction stage 56 of FIG. 2, subtraction stage 4 (of predictor 5 of FIG. 1) can replace summing stage 61 of FIG. 2, quantizing stage 10 (of predictor 5 of FIG. 1) can be identical to quantizing stage 60 of FIG. 2, and IIR filter 7 (of predictor 5 of FIG. 1) can be identical to FIG. 2's FIR filter 57 (connected in the feedback configuration shown in FIG. 2), except in that each value output from such implementation of filter 7 is the additive inverse of the value that would be output from filter 57 in response to the same input.

We next describe decoder 21 of FIG. 3.

Typically, multiple channels of coded input data samples are asserted to the inputs of decoder 21. Each channel typically includes a stream of coded input audio samples and can correspond to a different channel (or mix of channels determined by rematrixing in encoder 1) of a multi-channel audio program.

Decoder 21 is configured to perform the following functions: an unpacking operation (represented by unpacking stage 23 of FIG. 3), a Huffman decoding operation (represented by Huffman decoding stage 25), a block floating point representation decoding operation (represented by stage 27), a prediction operation (including generation of predicted samples and generating decoded samples therefrom) represented by predictor 29, and a rematrixing operation (represented by rematrixing stage 41. In some implementations, decoder 21 is a digital signal processor (DSP) programmed and otherwise configured to perform these functions (and optionally additional functions) in software.

Decoder 21 operates as follows:

unpacking stage 23 unpacks the Huffman coded values (from coder 13 of encoder 1), all side chain words (from stages of encoder 1), and the filter coefficient data (from predictor 5 of encoder 1), and provides the unpacked coded values for processing in Huffman decoder 25, the filter coefficient data for processing in predictor 29, and subsets of the side chain words for processing in stages of decoder 21 as appropriate. Stage 23 may unpack values that determine the size (e.g., number of microblocks) of each macroblock of received Huffman coded values (the size of each macroblock would determine the intervals at which IIR filter 31 and FIR filter 33 (of predictor 29 of decoder 21) should be reconfigured).

In Huffman decoding stage 25, the Huffman coded values are decoded (by performing the inverse of the Huffman coding operation performed in encoder 1), and the resulting Huffman decoded values are provided to block floating point representation decoding stage 27.

In block floating point representation decoding stage 27, the inverse of the encoding operation that was performed in stage 11 of encoder 1 is performed (on blocks of the Huffman decoded values) to recover coded values $V_x$. Each of the values $V_x$ is equal to the sum of a quantized residual that was generated by the encoder's predictor (each quantized residual corresponds to a coded sample, $S_x$, generated in rematrixing stage 3 of encoder 1) and the MSBs of the coded sample, $S_x$. The value of the quantized residual is $S_x-P_x$, where $P_x$ is the predicted value of $S_x$ generated in predictor 5 of encoder 1). The coded values $V_x$ are provided to predictor stage 29. In effect, each exponent determined by the output of block floating point stage 11 of encoder 1 is added back to the mantissas of the relevant block (also determined by the output of stage 11). Predictor 29 operates on the result of this operation.

In predictor 29, FIR filter 33 is typically identical to IIR filter 7 of encoder 1 of FIG. 1, except in that FIR filter 33 is connected in a feedforward configuration in predictor 29 (whereas filter 7 is connected in a feedback configuration in predictor 5 of encoder 1), and IIR filter 31 is typically identical to FIR filter 9 of encoder 1 of FIG. 1, except in that IIR filter 31 is connected in a feedback configuration in predictor 29 (whereas filter 9 is connected in a feedforward configuration in predictor 5 of encoder 1). In such typical embodiments, each of filters 7, 9, 31, and 33 is implemented with an FIR filter structure (and each can be considered to be an FIR filter), but each of filters 7 and 31 is referred to herein as an "IIR" filter when connected in a feedback configuration.

Predictor 29 performs the following operations: subtracting (represented by subtraction stage 30), summing (represented by summing stage 34), IIR filtering (represented by IIR filter 31), FIR filtering (represented by FIR filter 33), quantization (represented by quantizing stage 32), and configuration of IIR filter 31 and FIR filter 33, and updating of the configurations of filters 31 and 33. In response to the filter coefficient data (from predictor 5 of the encoder, as unpacked in stage 23), predictor 29 configures FIR filter 33 with a selected one of the sets of IIR coefficients of IIR coefficient palette 8 (this set of coefficients is typically identical to a set of coefficients that were employed in encoder 1 to configure IIR filter 7), and typically also configures IIR filter 31 with coefficients included in (or otherwise determined by) the filter coefficient data (these coefficients are typically identical to coefficients that were employed in encoder 1 to configure FIR filter 9). If the filter coefficient data determines (rather than includes) the current set of IIR coefficients to be used to configure filter 33, the current set of IIR coefficients is loaded from palette 8 of predictor 29 (in FIG. 3) into filter 33 (in this case, palette 8 of FIG. 3 is identical to the identically numbered palette of predictor 5 in FIG. 1).

If the filter coefficient data includes (rather than determines) the current set of IIR coefficients to be used to configure filter 33, then palette 8 is omitted from decoder 21 (i.e., no palette of IIR coefficients is prestored in decoder 21) and the filter coefficient data itself is used to configure the filter 33. As noted, in alternative embodiments in which the filter coefficient data determines one of the sets of IIR coefficients (in palette 8) to be used to configure filter 33, then this set of IIR coefficients can be selected from palette 8 (which has been prestored in decoder 21) and used to configure the filter 33. In either case, FIR filter 33 (when used to decode data that has been encoded in predictor 5 with filter 7 using a specific set of IIR coefficients) is configured with the same set of IIR coefficients. Similarly, when the filter coefficient data includes a set of FIR coefficients that has been used to configure FIR filter 9 of predictor 5 (of FIG. 1), IIR filter 31 is configured with this set of FIR coefficients (for use by filter 31 to decode data that has been encoded in predictor 5 with filter 9 using the same FIR coefficients). The configuration of FIR filter 33 (and IIR filter 31) is typically updated in response to each new set of filter coefficient data.

In alternative decoder implementations (in which palette 8 of FIG. 3 is typically not identical to palette 8 of FIG. 1, but in which palette 8 of FIG. 3 does include predetermined sets of IIR coefficients for configuring filter 31), predictor 29 is operable in a configuration mode (e.g., of the same type as predictor 5 of encoder 1 is operable to perform) to select one of the sets of IIR coefficients from the predetermined IIR coefficient palette 8 (in accordance with any embodiment of the inventive method), and to configure IIR filter 31 with the selected one of the sets, and typically also to configure FIR filter 33 accordingly (e.g., in accordance with any embodiment of the inventive method). In some such implementations, predictor 29 is operable to update filters 31 and 33 adaptively (e.g., in accordance with any embodiment of the inventive method). The alternative implementations described in this paragraph would not be suitable for losslessly reconstructing data that had been encoded in a lossless encoder, unless they could configure filters 31 and 33 so that predictor 29's configuration matches the configuration of its counterpart in the encoder, for decoding samples coded with the encoder's predictor in such configuration.

In any embodiment of the inventive decoder that includes both IIR filter 31 and FIR filter 33, each time the configuration of one of IIR filter 31 and FIR filter 33 is determined (or updated), the configuration of the other one of filters 31 and 33 is determined (or updated). In typical cases, this is done by configuring both filters 31 and 33 with coefficients included in a current set of filter coefficient data (that has been received from an encoder and unpacked in stage 23). In these cases, the encoder transmits all required FIR and IIR coefficients to the decoder so that the decoder does not have to perform any calculations and does not need to know the IIR palette used by the encoder (which can be changed at any time without any need to alter the existing decoders). In these cases, the need for coefficient transmission (to the decoder from the encoder) typically imposes constraints on the process of generating the IIR coefficient palette that is employed in the encoder, since there is typically a maximum number of IIR+FIR coefficients that can be sent to the decoder, a maximum total number of filter stages that can be used (in the encoder's predictor and the decoder's predictor), and a maximum total number of bits that can be used for the transmitted coefficients.

With reference again to decoder 21 of FIG. 3, filters 31 and 33 are implemented and configured so that their combined outputs, in response to the sequence of coded values $V_x$ (generated in stage 27), are indicative of a predicted next coded value $V_x$ in the sequence. In stage 30, predictor 29 subtracts each current value of the output of filter 33 from the current value of the output of filter 31 to generate a sequence of predicted values. In quantizing stage 32, predictor 29 generates a sequence of quantized values by performing a rounding operation (e.g., to the nearest integer) on each predicted value generated in stage 30.

In stage 34, predictor 29 adds each quantized current value of the combined output of filters 31 and 33 (the predicted next coded value $V_x$ output from stage 32) to each current value of the sequence of the coded values $V_x$ to generate a sequence of coded values $S_x$.

Each of the coded values $S_x$ generated in stage 34 is an exactly recovered version of a corresponding one of the coded audio samples $S_x$ that were generated in rematrixing stage 3 of encoder 1 (and then underwent prediction encoding in predictor stage 5 of encoder 1). Each sequence of quantized values $S_x$ generated in predictor stage 29 is identical to a corresponding sequence of coded values $S_x$ that was generated in rematrixing stage 3 of encoder 1.

The quantized values $S_x$ generated in predictor stage 29 undergo rematrixing in rematrixing stage 41. In rematrixing stage 41, the inverse of the rematrixing encoding that was performed in stage 3 of encoder 1 is performed on the values $S_x$, to recover the original input audio samples that were originally asserted to encoder 1. These recovered samples, labeled as "output audio samples" in FIG. 3, typically comprise multiple channels of audio samples.

Each encoding stage of the FIG. 1 system typically generates its own side chain data. Rematrixing stage 3 generates rematrixing coefficients, predictor 5 generates updated sets of IIR filter coefficients, Huffman coder 13 generates an index to a specific Huffman lookup table (for use by decoder 21, which should implement the same lookup table), and block floating point representation stage 11 generates a master exponent for each block of samples plus individual sample mantissas. Packing stage 15 implements a master packing routine that takes all the side chain data from all the encoding stages and packs it all together. Unpacking stage 23 in the FIG. 3 decoder performs the reverse (unpacking) operation.

Predictor stage 29 of decoder 21 applies the same predictor implemented by encoder 1 to a sequence of values input thereto (from stage 27) to predict a next value in the sequence. In a typical implementation of predictor stage 29, each predicted value is added to the corresponding value received from stage 27, to reconstruct a coded sample that was output from encoder 1's rematrixing stage 3. Decoder 21 also performs the inverses of the Huffman coding and rematrixing operations (performed in encoder 1) to recover the original input samples asserted to encoder 1.

The FIG. 1 system is preferably implemented as a lossless digital audio coder, and the decoded output (produced at the output of a compatible implementation of the FIG. 3 decoder) must match the input to the FIG. 1 system exactly, bit-for-bit. Preferred implementations of the inventive encoder and decoder (e.g., the FIG. 1 encoder and the FIG. 3 decoder) share a common protocol for expressing certain classes of signals in a more compact form, such that the data rate of the coded data output from the encoder is reduced but the decoder can recover the original signal input to the encoder.

Predictor 5 of the FIG. 1 system uses a combination of IIR and FIR filters (FIR filter 9 and IIR filter 7). Working together, the filters generate an estimate of the next audio sample based on previous samples. The estimate is subtracted (in stage 6) from the actual sample, resulting in a reduced amplitude residual sample which is quantized and asserted to stage 11 for further encoding. An advantage of using a prediction filter including both feedback and feedforward filters (e.g., IIR filter 7 and FIR filter 9) is that each of the feedback and feedforward filters can be effective under signal conditions for which it is best suited. For example, FIR filter 9 can compensate for a peak in signal spectrum with fewer coefficients than IIR filter 7, while the reverse holds true for a sudden drop-off in signal spectrum. Alternatively, some embodiments of the inventive prediction filter (and an encoder or decoder in which it is implemented) include only a feedback (IIR) filter.

In order to function effectively, the coefficients of the FIR and IIR filters in embodiments of the inventive predictor should be selected to match the characteristics of the input signal to the predictor. Efficient standard routines exist for designing an FIR filter given a signal block (e.g., the Levinson-Durbin recursion method), but no such algorithm exists for configuring an IIR filter, either in isolation or in concert with an FIR filter. To allow efficient selection of IIR filter coefficients (to configure an IIR filter of a predictor) in accordance with a class of embodiments of the invention, a palette of pre-computed IIR filter coefficient sets defining a set of IIR filters is generated using constrained nonlinear optimization (e.g., one or both of a constrained Newtonian method and a constrained Simplex method). This process may be time consuming, since it is performed preliminary to actual configuration of a prediction filter using the palette. The palette comprising the sets of IIR filter coefficients (each set defining an IIR filter) is made available to the system (e.g., an encoder) that implements the prediction filter to be configured. Typically, the palette is stored in the system (e.g., the encoder) but alternatively it may be stored external thereto and accessed when needed. The memory in which the palette is stored is sometimes referred to herein for convenience as the palette itself (e.g., palette 8 of predictor 5 is a memory which stores a palette that has been generated in accordance with the invention). The palette is preferably small enough (sufficiently short) that the encoder can rapidly try each IIR filter determined by a set of coefficients in the palette, and choose the one that works best. After trying each candidate IIR filter, an encoder (which implements a prediction filter including an FIR filter as well as the IIR filter) can perform an efficient Levinson-Durbin recursion to the IIR residual output (determined using the IIR filter, configured with the selected coefficient set) to determine an optimal set of FIR filter coefficients. The FIR filter and IIR filter are configured in accordance with the determined best combination of IIR and FIR configurations, and are applied to produce prediction filtered data (e.g., the sequence of residuals conveyed from prediction stage 5 of FIG. 1 to stage 11). In alternative encoder embodiments, the prediction filtered data produced by the configured prediction filter (e.g., the residuals produced by configured stage 5 in response to each block of samples input thereto) are transmitted to the decoder without being further encoded, along with the selected IIR filter coefficients employed to generate the data (or with filter coefficient data identifying the selected IIR coefficients).

In a preferred embodiment, the inventive encoder (e.g., encoder 1 of FIG. 1) is implemented to operate with sample block size that is variable in the following sense. For example, as noted above in connection with the adaptive updating of the configurations of filters 7 and 9, encoder 1 is preferably operable to determine how many microblocks of the coded samples (generated in stage 3) to further encode using each determined configuration of filters 7 and 9. In such preferred embodiments, encoder 1 effectively determines the size of a "macroblock" of the coded samples (generated in stage 3) that will be encoded using each determined configuration of filters 7 and 9 (without updating the configuration). For example, a preferred embodiment of predictor 5 of encoder 1 may determine the size of each macroblock of the coded samples (generated in stage 3) to be encoded, using each determined configuration of filters 7 and 9, to be a number N (where N is in the range $1 \leq N \leq 128$) of the microblocks. To determine the optimal number N, predictor 5 may operate to update the filters 7 and 9 once per each microblock (e.g., consisting of 48 samples) of samples and to filter each of a sequence of microblocks, then to update the filters 7 and 9 (e.g., in any of the ways described herein) once per each sequence of X microblocks and to filter each of a sequence of such groups of microblocks, and then to update the filters 7 and 9 once per each larger group of microblocks and to filter each of a sequence of such larger groups of microblocks, and so on in a sequence (e.g., up to a group of 128 of the microblocks), and to determine from the resulting data the optimal macroblock size (optimal number N of the microblocks per macroblock). For example, the optimal macroblock size may be the maximum number of microblocks that can be grouped together to make each macroblock without unacceptably increasing the RMS level of the residuals generated by predictor 5 (or the RMS level of the output data stream generated by encoder 1, including all overhead data).

In some embodiments, adaptive updating of IIR filter 7 and FIR filter 9 is performed once (or Z times, where Z is some determined number) per macroblock (e.g., once per each 128 microblocks of samples to be encoded by encoder 1), but not more than once per microblock of samples to be encoded by encoder 1. In some embodiments, encoding operation of encoder 1 is disabled for the first X (e.g., X=8) samples in each macroblock (IIR filter 7 and FIR filter 9 may be updated during the periods in which the encoding operation is disabled). The X unencoded samples per macroblock are passed through to the decoder.

Some embodiments of encoder 1 constrain the intervals between events of adaptive updating of the prediction filter configurations (e.g., the maximum frequency at which updating of filters 7 and 9 is allowed to occur), e.g., to optimize efficiency of the encoding. Each time IIR filter 7 in encoder 1 (implemented as a lossless encoder) is reconfigured in accordance with the invention, there is a state change in the encoder that requires that overhead data (side chain data) indicative of the new state be transmitted to allow decoder 21 to account for each state change during decoding. However, if the encoder state change occurs for some reason that is not an IIR filter reconfiguration (e.g., a state change occurring at the start of processing of a new macroblock of samples), overhead data indicative of the new state must also be transmitted to decoder 21 so that reconfiguration of filter 7 and 9 may be performed at this time without adding (or without adding significantly or intolerably) to the amount of overhead that must be transmitted. Thus, some embodiments of encoder 1 are configured to perform a continuity determination operation to determine when there is an encoder state change, and to control the timing of operations to reconfigure filters 7 and 9 accordingly (e.g., so that reconfiguration of filters 7 and 9 is deferred until occurrence of a state change event at the start of a new macroblock).

We next describe four aspects of preferred software embodiments of the inventive method and system. The first two are preferred methods (and systems programmed to perform them) for generating a palette of IIR filter coefficients to be provided to an encoder, for use in configuring a prediction filter of the encoder (where the prediction filter includes an IIR filter and optionally also an FIR filter). The second two are preferred methods (and systems programmed to perform them) for using the palette to configure a prediction filter of an encoder, where the prediction filter includes an IIR filter and optionally also an FIR filter.

Typically, a processor (appropriately programmed with firmware or software in accordance with an embodiment of the invention) is operated to generate a master palette of IIR filter coefficients to be provided to an encoder. As described above, each set of coefficients in the master palette can be generated by performing nonlinear optimization over a set (a "training set") of input signals (e.g., audio data samples), subject to at least one constraint. Since this process may yield an unacceptably large master palette, a pruning process may be performed on the master palette (to cull IIR coefficient sets therefrom and thereby generate a smaller final palette of IIR coefficient sets) based on some combination of histogram accumulation and net improvement provided by each candidate IIR filter over the training set.

In a typical embodiment, a master IIR coefficient palette is pruned as follows to derive a final palette. For each block of signal samples of each signal in a (possibly different) training set of signals (possibly different than the training set used to generate the master palette), for each candidate IIR filter in the master palette, a corresponding FIR filter is calculated using Levinson-Durbin recursion. Residuals generated by the combined candidate IIR filter and FIR filter are evaluated, and the IIR coefficients that determine the IIR filter of the combination of IIR filter and FIR filter that produces the residual signal having a lowest RMS level is selected for inclusion in the final palette (the selection may be conditioned on maximum Q and desired precision of the IIR/FIR filter combination). Histograms may be accumulated of total usage of each filter and net improvement. After processing the training set, the least effective filters are pruned from palette. The training procedure may be repeated until a palette of the desired size is attained.

In preferred embodiments, the inventive method generates the palette of IIR filter coefficients such that each IIR filter determined by each set of coefficients in the palette has an order which can be selected from a number of different possible orders. For example, consider one of the sets (a "first" set) of IIR coefficients in such a palette. The first set may be useful for configuring an IIR filter having selectable order in the following sense: a first subset (of the coefficients in the first set) determines a selected first-order implementation of the IIR filter, and at least one other subset (of the coefficients in the first set) determines a selected Nth-order implementation of the IIR filter (where N is an integer greater than one, e.g., N=4 to implement a fourth-order IIR filter). In a preferred embodiment, the prediction filter to be configured using the palette (e.g., a preferred implementation of the prediction filter implemented by stage 5 of encoder 1) includes an IIR filter and an FIR filter, and during configuration of the prediction filter using the palette, orders of these filters are selectable subject to the constraints that the order of the IIR filter is in the range from 0 to X inclusive (e.g., X=4), the order of the FIR filter is in a range from 0 to Y (e.g., Y=12), and the selected orders of the IIR filter and the FIR filter can sum to a maximum of Z (e.g., Z=12).

As noted, each set of coefficients in the palette can be generated by performing nonlinear optimization over a set (a "training set") of input signals (e.g., audio data samples), subject to at least one constraint. In some embodiments, this is done as follows (assuming that the prediction filter to be configured using the palette will apply both an FIR filter and an IIR filter to generate residuals). For each trial set of IIR coefficients of each optimizer recursion on each sample block, a Levinson-Durbin FIR design routine is performed to derive optimal FIR prediction filter coefficients corresponding to the IIR prediction filter determined by the trial set. A best combination of IIR/FIR filter order and IIR (and corresponding FIR) coefficient values is determined based on minimum prediction residual, conditioned by limitations on transmission overhead, maximum filter Q, numerical coefficient precision, and stability. For each signal in the trial set, the trial IIR coefficient set included in a "best" IIR/FIR combination determined by the optimization is included in the master palette (if not already present). The process continues to accumulate an IIR coefficient set in the master palette for each signal in the entire training set.

A preferred method (and system programmed to perform it) for using an IIR coefficient palette determined in accordance with the invention to configure a prediction filter of an encoder (where the prediction filter includes an IIR filter and an FIR filter), includes the following steps: for each block of a set of input data, each IIR filter determined by the coefficient sets in the palette is applied to generate first residuals, a best FIR filter configuration for each IIR filter is determined by applying a Levinson-Durbin recursion method to the first residuals (e.g., to determine an FIR configuration which, when applied to the first residuals, results in a set of prediction residuals having lowest level (e.g. lowest RMS level) including by accounting for coefficient transmission overhead (e.g., including overhead required to be transmitted with each set of prediction residuals and choosing the FIR configuration which minimizes the level of the prediction residuals including the overhead), and configuring the prediction filter with the best determined combination of IIR coefficients and FIR coefficients.

A preferred method (and system programmed to perform it) for using an IIR coefficient palette determined in accordance with the invention to configure a prediction filter of an encoder (where the prediction filter includes an IIR filter and an FIR filter), includes the following steps: using the palette to determine a best combination of IIR coefficients and FIR coefficients (in accordance with any embodiment of the invention), and setting the state of the prediction filter using the determined best combination of IIR coefficients and FIR coefficients in a manner accounting for (and preferably so as to maximize) output signal continuity (e.g., using least-squares optimization). For example, the prediction filter may not be reconfigured with the newly determined set of IIR and FIR coefficients if to do so would require transmission of unacceptable overhead data (e.g., to indicate a state change resulting from the reconfiguration to the decoder), or the prediction filter may be reconfigured with the newly determined set of IIR and FIR coefficients at a time coinciding with a state change at the start of a new macroblock of samples to be prediction encoded.

To enable the practical use of a feedback predictor (a predictor including a prediction filter which includes a feedback filter, with or without augmentation by feedforward prediction), an encoder including the predictor is provided with a list ("palette") of pre-calculated feedback filter coefficients in accordance with some embodiments of the invention. When a new filter is to be selected, the encoder need only try each feedback (IIR) filter determined by the palette (on a set of input data values, e.g. a block of audio data samples) to determine the best choice, which is generally a rapid calculation if the palette is not too large. For example, a best set of coefficients for the predictor may be determined by trying each set of coefficients in the palette, and selecting the set of coefficients that results in a residual signal having a lowest RMS level as the "best" set of coefficients (where a residual signal is generated for each set of coefficients by applying the prediction filter, configured with said set, to an input signal, e.g., to the input signal to be encoded or another signal having characteristics similar to the input signal to be encoded). Typically, it is best to minimize the RMS level of the residual, as this will allow a block floating point processor (or other encoding stage) to minimize bits of the encoded data generated thereby.

In some embodiments, the method for selecting a best combination of FIR/IIR filter configurations (or a best IIR filter configuration) for a prediction encoder in a multi-stage encoder, where the multi-stage encoder includes other encoding stages (e.g., block floating point and Huffman coding stages) as well as the prediction encoder, considers the result of applying all encoding stages (including the predictor) to an input signal (with the prediction encoder configured with each candidate set of IIR coefficients determined by a palette). The selected combination of FIR/IIR filter coefficients (or best set of IIR coefficients) may be the one which results in the lowest net data rate of the fully encoded output from the multi-stage encoder. However, since such a calculation may be time consuming, the RMS level (also taking into consideration the side chain overhead) of the output of the prediction encoding stage alone may be used the criterion for determining a best combination of FIR/IIR filter coefficients (or a best set of IIR coefficients) for the prediction encoder stage of such a multi-stage encoder.

Also, since a reconfiguration of a prediction filter in an encoder (to implement a new set of IIR filter coefficients, or IIR and FIR filter coefficients), may introduce a brief transient which will increase the data rate of the output of the encoder, it is sometimes preferable to account for the overhead associated with each such transient in determining timing of a contemplated reconfiguration of the prediction filter.

As noted above, a recursion method (e.g., a Levinson-Durbin recursion) is used in some embodiments of the invention to determine a set of FIR filter coefficients for configuring the FIR filter of a prediction filter, where the prediction filter includes both an FIR filter and an IIR filter, and a set of IIR filter coefficients (for configuring the IIR filter) has already been determined (e.g., using any embodiment of the inventive method). In this context, the FIR filter may be an N-th order feedforward predictor filter, and the recursion method may take as input a block of samples (e.g., samples generated by applying the IIR filter, configured with the determined set of IIR filter coefficients, to data), and determine using recursive calculations an optimal set of FIR filter coefficients for the FIR filter. The coefficients may be optimal in the sense that they minimize the mean-square-error of a residual signal. Each iteration during the recursion (before it converges to determine an optimal set of FIR filter coefficients) typically assumes a different set of FIR filter coefficients (sometimes referred to herein as a "candidate set" of FIR filter coefficients). In some cases, the recursion may start by finding optimal 1st order predictor coefficients, then use those to find optimal 2nd order predictor coefficients, then use those to find optimal 3rd order predictor coefficients, and so on until an optimal set of filter coefficients for the N-th order feedforward predictor filter has been determined.

In typical embodiments, the inventive system includes a general or special purpose processor programmed with software (or firmware) and/or otherwise configured to perform an embodiment of the inventive method. A digital signal processor (DSP) suitable for processing the expected input data (e.g., audio samples) will be a preferred implementation for many applications. In some embodiments, the inventive system is a general purpose processor, coupled to receive input data indicative of waveform signal samples (e.g., audio samples), and programmed (with appropriate software) to generate output data in response to the input data by performing an embodiment of the inventive method (e.g., to generate a palette of IIR filter coefficients, and/or to perform a prediction filtering operation on data samples and adaptively update the configuration of an IIR filter and an FIR filter of the prediction filter employed to perform the filtering). In some embodiments, the inventive system is an encoder (implemented as a DSP), a decoder (implemented as a DSP), or another DSP, that is programmed and/or otherwise configured to perform an embodiment of the inventive method on data indicative of waveform signal samples (e.g., audio samples).

FIG. 4 is an elevational view of computer readable optical disk 50, on which is stored code for implementing an embodiment of the inventive method (e.g., for generating a palette of IIR filter coefficients, and/or performing a prediction filtering operation on data samples and adaptively updating the configuration of an IIR filter and an FIR filter of the prediction filter employed to perform the filtering). For example, the code may be executed by a processor to generate a palette of IIR filter coefficients (e.g., palette 8). Or, the code may be loaded into an embodiment of encoder 1 to program encoder 1 to perform a prediction filtering operation (in predictor 5) in accordance with an embodiment of the invention on data samples and to adaptively update the configuration of IIR filter 7 and FIR filter 9 in accordance with an embodiment of the invention, or into an embodiment of decoder 21 to program decoder 21 to perform a prediction filtering operation (in predictor 29) in accordance with an embodiment of the invention on data samples and to adaptively update the configuration of IIR filter 31 and FIR filter 33 in accordance with an embodiment of the invention.

While specific embodiments of the present invention and applications of the invention have been described herein, it will be apparent to those of ordinary skill in the art that many variations on the embodiments and applications described herein are possible without departing from the scope of the invention described and claimed herein. It should be understood that while certain forms of the invention have been shown and described, the invention is not to be limited to the specific embodiments described and shown or the specific methods described.

What is claimed is:

1. A method, performed by an audio encoding device, for encoding an audio input signal using a prediction filter including an infinite impulse response (IIR) filter and a finite impulse response (FIR) filter, the prediction filter configured with a predetermined palette of IIR coefficient sets, said method including the steps of:

(a) for each of the IIR coefficient sets in the palette, generating configuration data indicative of an output signal generated by applying the IIR filter configured with said each of the IIR coefficient sets to an audio signal derived in response to the audio input signal, the audio signal comprising a stream of audio signal samples received by the prediction filter, and identifying as a selected IIR coefficient set one of the IIR coefficient sets which configures the IIR filter to generate configuration data that satisfy a predetermined criterion;

(b) determining an optimal FIR filter coefficient set by performing a recursion operation on test data indicative of an output signal generated by applying the prediction filter to an audio signal derived in response to the audio input signal, the audio signal comprising a stream of audio signal samples received by the prediction filter, with the IIR filter configured with the selected IIR coefficient set;

(c) configuring the FIR filter with the optimal FIR coefficient set and configuring the IIR filter with the selected IIR coefficient set, thereby configuring the prediction filter;

(d) generating a prediction filtered audio signal by filtering an audio signal derived in response to the audio input signal with the configured prediction filter;

(e) generating an encoded audio signal in response to the prediction filtered audio signal; and (f) asserting, at least one output of the audio encoding device, the encoded audio signal and filter coefficient data indicative of the selected IIR filter coefficient set, wherein at least one of the steps is implemented, at least in part, by one or more hardware devices within the audio encoding device.

2. The method of claim 1, wherein step (a) includes the step of identifying, as the selected IIR coefficient set, one of the IIR coefficient sets which configures the IIR filter to generate configuration data having a lowest level.

3. The method of claim 1, wherein step (a) includes the step of identifying, as the selected IIR coefficient set, one of the IIR coefficient sets which configures the IIR filter to meet an optimal combination of criteria, wherein one of the criteria is generation of configuration data having lowest level.

4. The method of claim 1, wherein the filter coefficient data are the selected IIR coefficient set.

5. The method of claim 1, wherein step (a) includes the step of identifying as the selected IIR coefficient set, one of the IIR coefficient sets which configures the IIR filter to generate configuration data for which A+B has a lowest value, where A is indicative of a level of the configuration data and B is an amount of side chain data needed to identify said one of the IIR coefficient sets.

6. The method of claim 1, wherein step (a) includes the step of identifying as the selected IIR coefficient set, one of the IIR coefficient sets which configures the IIR filter to generate configuration data for which A+B has a lowest value, where A is indicative of a level of the configuration data and B is an amount of side chain data needed to identify said one of the IIR coefficient sets plus an amount of side chain data required for decoding data that have been encoded using the prediction filter configured with said one of the IIR coefficient sets.

7. The method of claim 1, wherein the audio encoding device performs lossless encoding of the audio input signal, and the encoded audio signal is a losslessly encoded audio signal.

8. An audio encoding device for encoding an audio input signal, including:

a prediction filter including an infinite impulse response (IIR) filter and a finite impulse response (FIR) filter, wherein the prediction filter is configured to be operable in a configuration mode in which the prediction filter uses a predetermined palette of IIR coefficient sets to configure the IIR filter and the FIR filter, including by generating, for each of the IIR coefficient sets in the palette, configuration data indicative of an output signal generated by applying the IIR filter configured with said each of the IIR coefficient sets to an audio signal derived in response to the audio input signal, and identifying as a selected IIR coefficient set one of the IIR coefficient sets which configures the IIR filter to generate configuration data that satisfy a predetermined criterion;

determining an optimal FIR filter coefficient set by performing a recursion operation on test data indicative of an output signal generated by applying the prediction filter to an audio signal derived in response the audio input signal with the IIR filter configured with the selected IIR coefficient set; and configuring the FIR filter with the optimal FIR coefficient set and configuring the IIR filter with the selected IIR coefficient set, thereby configuring the prediction filter, wherein at least one of the prediction filter and the subsystem are implemented, at least in part, by one or more hardware devices within the audio encoding device; and wherein the audio encoding device is configured to:

generate a prediction filtered audio signal by filtering an audio signal derived in response to the audio input signal with the configured prediction filter;

generate, using a subsystem coupled to the prediction filter, an encoded signal in response to the prediction filtered audio signal; and assert, at least one output of the audio encoding device, the encoded audio signal and filter coefficient data indicative of the selected IIR filter coefficient set.

9. The audio encoding device of claim 8, wherein the subsystem is configured to assert, at least one output, the encoded audio signal with filter coefficient data indicative of the selected IIR coefficient set.

10. The audio encoding device of claim 9, wherein the filter coefficient data are the selected IIR coefficient set.

11. The audio encoding device of claim 9, wherein the audio encoding device is a lossless audio encoding device and the prediction filter is configured to be operable to generate the prediction filtered signal in response to audio data samples.

12. The audio encoding device of claim 9, wherein the prediction filter is configured to be operable in the configuration mode to identify as the selected IIR coefficient set, one of the IIR coefficient sets which configures the IIR filter to generate configuration data for which A+B has a lowest value, where A is indicative of a level of the configuration data and B is an amount of side chain data needed to identify said one of the IIR coefficient sets.

13. The audio encoding device of claim 9, wherein the prediction filter is configured to be operable in the configuration mode to identify as the selected IIR coefficient set, one of the IIR coefficient sets which configures the IIR filter to generate configuration data for which A+B has a lowest value, where A is indicative of a level of the configuration data and B is an amount of side chain data needed to identify said one of the IIR coefficient sets plus an amount of side chain data required for decoding data that have been encoded using the prediction filter configured with said one of the IIR coefficient sets.

14. The audio encoding device of claim 8, wherein the palette of IIR filter coefficient sets comprises at least two sets of IIR filter coefficients, each of the sets consisting of coefficients sufficient to determine the IIR filter, and said palette has been predetermined by performing nonlinear optimization over a training set of input signals including by:

(a) determining at least one of the sets of IIR filter coefficients in the palette by performing nonlinear optimization over one of the input signals in the training set, subject to at least one constraint; and (b) determining at least one other one of the sets of IIR filter coefficients in the palette by performing nonlinear optimization over another one of the input signals in the training set, subject to the at least one constraint.

15. An audio decoding device coupled to receive filter coefficient data indicative of a selected infinite impulse response (IIR) coefficient set, wherein the selected IIR coefficient set has been selected from a predetermined palette of IIR coefficient sets according to the method of claim 1, wherein the audio decoding device is also coupled to receive a losslessly encoded audio signal, wherein the audio decoding device performs lossless decoding of the losslessly encoded audio signal, and wherein said audio decoding device includes:

a decoding subsystem configured to generate a partially decoded audio signal in response to the losslessly encoded audio signal; and a prediction filter, coupled to the subsystem and including an IIR and a finite impulse response (FIR) filter, wherein the prediction filter is configured to be operable to generate prediction filtered data in response to the partially decoded audio signal, and the prediction filter is configured to be operable to configure one of the IIR filter and the FIR filter with the selected IIR coefficient set in response to the filter coefficient data, wherein at least one of the decoding subsystem and the prediction filter is implemented, at least in part, by one or more hardware devices within the audio decoding device.

16. The audio decoding device of claim 15, wherein the filter coefficient data are the selected IIR coefficient set.

17. The audio decoding device of claim 15, wherein the IIR filter of the prediction filter is a finite impulse response filter in a feedback configuration, the filter coefficient data are also indicative of an FIR coefficient set, and the prediction filter is configured to be operable to configure the IIR filter with the FIR coefficient set and to configure the FIR filter with the selected IIR coefficient set in response to the filter coefficient data.

18. The audio decoding device of claim 15, wherein the subsystem is configured to be operable to generate the partially decoded audio signal in response to audio data samples.

* * * * *